US006830371B2

(12) United States Patent
Masaki

(10) Patent No.: US 6,830,371 B2
(45) Date of Patent: Dec. 14, 2004

(54) HIGH ACCURACY TIMEPIECE

(75) Inventor: Hiroyuki Masaki, Chiba (JP)

(73) Assignee: Seiko Instruments Inc., Chiba (JP)

( * ) Notice: Subject to any disclaimer, the term of this patent is extended or adjusted under 35 U.S.C. 154(b) by 44 days.

(21) Appl. No.: 10/233,035

(22) Filed: Aug. 31, 2002

(65) Prior Publication Data

US 2003/0063526 A1 Apr. 3, 2003

Related U.S. Application Data

(62) Division of application No. 09/426,529, filed on Oct. 26, 1999, now Pat. No. 6,616,328.

(30) Foreign Application Priority Data

Oct. 30, 1998 (JP) ..... 10-310489

(51) Int. Cl.[7] ..... G04C 9/00
(52) U.S. Cl. ..... 368/187; 368/319; 368/304
(58) Field of Search ..... 368/184–187, 368/203–204, 319

(56) References Cited

U.S. PATENT DOCUMENTS 4,141,208 A 2/1979 Whipple et al.
4,209,975 A * 7/1980 Moritani et al. ..... 368/186
4,290,129 A * 9/1981 Ushikoshi ..... 368/66
4,316,274 A * 2/1982 Ushikoshi ..... 368/66
4,320,476 A 3/1982 Berney ..... 368/28
4,634,288 A * 1/1987 Lobato ..... 368/200
5,717,661 A * 2/1998 Poulson ..... 368/202
6,072,752 A * 6/2000 Igarashi et al. ..... 368/80
6,381,702 B1 * 4/2002 Ogasawara ..... 713/500
6,510,108 B2 * 1/2003 Ogasawara ..... 368/37

FOREIGN PATENT DOCUMENTS

DE 2484103 12/1981
JP 5300863 * 1/1978 ..... 368/186

OTHER PUBLICATIONS

Patent Abstracts of Japan, vol. 005, No. 056 (P–057) Apr. 17, 1981 publication No. 56011384, publication date Feb. 4, 1981.

* cited by examiner

*Primary Examiner*—Tulsidas Patel
*Assistant Examiner*—Jeanne-Marguerite Goodwin
(74) *Attorney, Agent, or Firm*—Adams & Wilks

(57) ABSTRACT

An accuracy adjustment apparatus for a timepiece has an accuracy adjustment data input control section including a case-mounted switch such as a crown of the timepiece. A crown state detection signal is used to determine the state of the crown. When an accuracy adjustment data input mode is indicated based on the position of the crown, an indicator of the timepiece is driven to provide a visual indication of accuracy adjustment data selectable by operation of the crown. When the proper accuracy adjustment data has been selected, the data is stored to a memory.

10 Claims, 12 Drawing Sheets

HIGH ACCURACY TIMEPIECE

The present application is a division of U.S. application Ser. No. 09/426,529 filed on Oct. 26, 1999 now U.S. Pat. No. 6,616,328, which is hereby incorporated by reference, and priority thereto for common subject matter is hereby claimed.

BACKGROUND OF THE INVENTION

1. Field of the Invention

The present invention relates to a high-accuracy timepiece the accuracy adjustment of which can be made in an assembled state and in which accuracy readjustment is not necessary even after a power supply has been temporarily removed. More particularly, the invention is directed to an inexpensive high-accuracy timepiece in which accuracy adjustment can be made by operating a crown or other external input means.

2. Description of the Prior Art

A high-accuracy timepiece guaranteeing an accuracy of 10 seconds a year is now marketed together with an ordinary accuracy timepiece guaranteeing an accuracy of 15 seconds a month. For assembling the high-accuracy timepiece from a movement state to a complete state, one cannot ignore accuracy errors caused by the pressure applied to the crystal oscillator, the floating capacitances fluctuating from one component to another and the like. Therefore, it is necessary to make accuracy adjustments in the complete state. An accuracy adjustment of a conventional high-accuracy timepiece is made in the complete state as follows. A reference signal lasting for a predetermined time period is inputted off line, and the inputted reference signal is compared with a internal signal to thereby measure a deviation from a reference rate, and rate adjustment data, known as rate fast/slow data or logical acceleration/deceleration data (logic fast/slow data for correcting the deviation from the reference rate) is stored in a writable nonvolatile memory such as an EEPROM. In a digital timepiece disclosed in Japanese Patent Application Laid-Open No. Sho 56-168187, an accuracy adjustment is made by setting rate fast/slow data while operating a button, and storing the data in a volatile memory.

The former conventional technology has addressed the problem that it requires a receiving circuit to be added inside the timepiece and new manufacturing equipment for outputting a reference signal to be provided. Further, a writable nonvolatile memory such as an EEPROM is comparatively expensive among other components of the timepiece, and thus the use of the memory has elevated the cost of the timepiece. On the other hand, the latter conventional technology has addressed the following problems. Since the set rate fast/slow data is erased when a power supply is replaced, the rate must be readjusted. In addition, a button and a liquid crystal display must be provided for inputting the rate fast/slow data, and thus an analog timepiece without a button and a liquid crystal display cannot be applied to a high-accuracy timepiece.

The present invention has been made in view of the aforementioned circumstances, and therefore an object thereof is to provide an inexpensive high-accuracy timepiece which allows rate fast/slow data to be inputted in a complete state and which does not allow the rate fast/slow data to be deleted even when a power supply is replaced.

SUMMARY OF THE INVENTION

A high-accuracy timepiece according to the present invention allows rate fast/slow data to be inputted from a crown that is already provided on the timepiece in order to allow the rate fast/slow data to be inputted in a complete state even if a receiving circuit and a button are not provided. Further, the high-accuracy timepiece includes data storage means such as an EEPROM which is writable and which allows data stored before a power supply is temporarily removed to remain unchanged even after the power supply has been temporarily removed so that the rate fast/slow data and other data is not deleted when the power supply has been replaced.

Here, in inputting the rate fast/slow data, the day wheel is used not only to determine what operation has been performed by an external part at what timing but also to give an indication for inputting the rate fast/slow data and for checking the stored rate fast/slow data. Further, the second hand, the minute hand or the hour hand may be used to do the same in place of the day wheel. Still further, the day wheel may be driven by another motor, or the same motor using an oscillation mechanism.

Further, by allowing two sets of rate fast/slow data for making a rough adjustment and a fine adjustment to be stored in separate means, the timepiece is arranged so as not to lose its accuracy to so large an extent even in the case where the rate fast/slow data for making a fine adjustment has been deleted.

Next, a volatile memory and a power backup capacitor are used jointly as data storage means in place of an expensive writable nonvolatile memory, thereby reducing the cost. Still further, by using power supply removal detection means for detecting removal of a power supply and oscillation control means for controlling oscillation means to stop or resume an oscillation, the power consumption is suppressed.

Further, by using data holding determination means, whether or not data in the data storage means has been held is determined, and the determination result is indicated on indication means.

Here, when the oscillation control means has determined that the power supply has been removed, first, the data storage means stores a plurality of copied data such as the rate fast/slow data. Then, when the operation of resuming an oscillation has been performed by inserting a new power supply, the data holding determination means obtains the plurality of copied data that have been stored and determines whether the data has been held by comparing the obtained data. The determination result is indicated on the indication means.

BRIEF DESICRIPTION OF THE DRAWINGS

A preferred form of the present invention is illustrated in the accompanying drawings in which.

DETAILED DESCRIPTION OF THE PREFERRED EMBODIMENTS

A high-accuracy timepiece of the present invention will now be described in detail with reference to the accompanying drawings in the order of [First Embodiment] to [Fifth Embodiment].

First Embodiment

Figure 1:
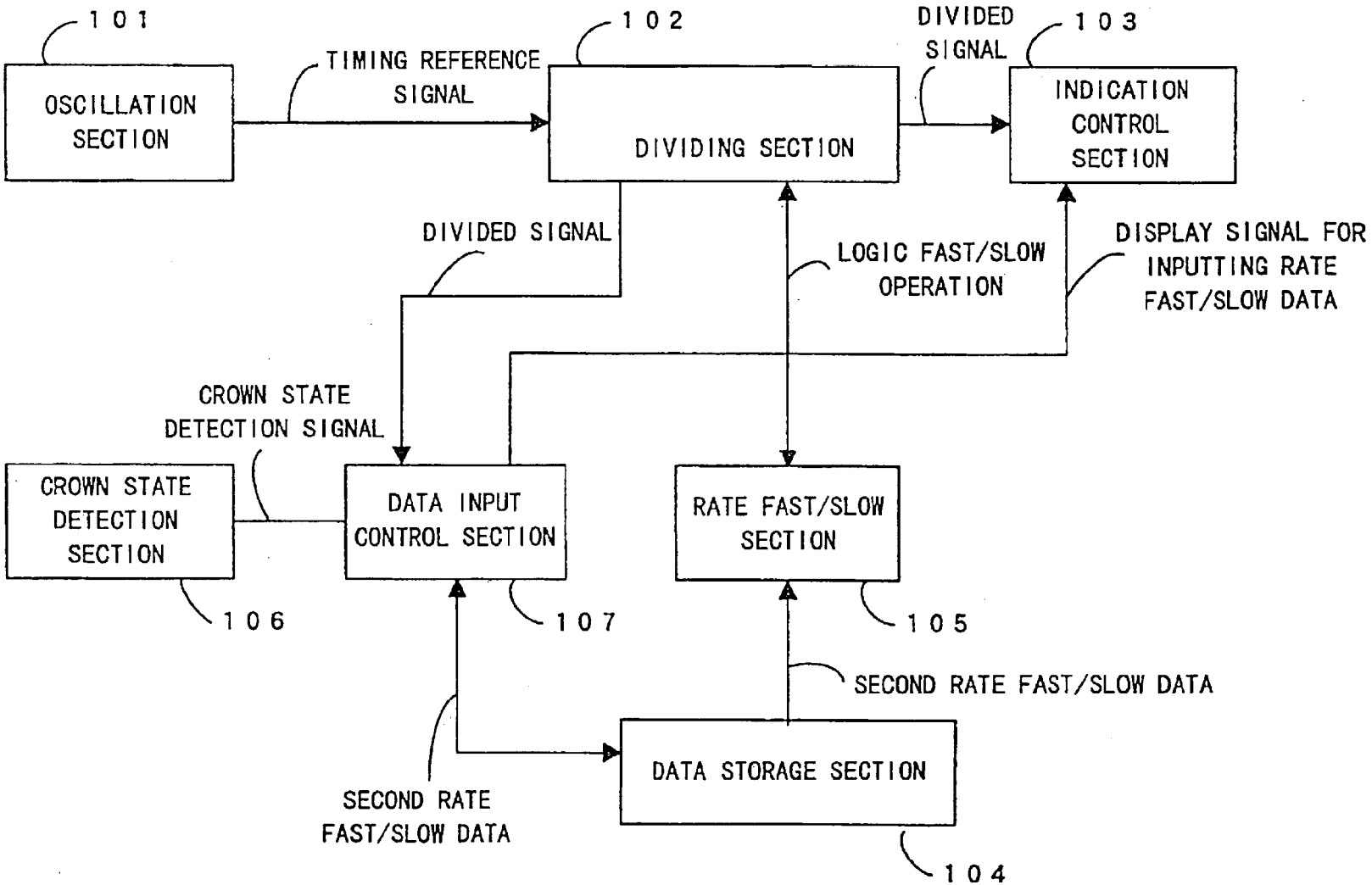
FIG. 1 is a block diagram showing the construction of and the flow of signals in a high-accuracy timepiece according to a first embodiment of the present invention.

FIG. 1 is a block diagram showing the construction of and the flow of signals in a high-accuracy timepiece according to a first embodiment of the present invention. The high-accuracy timepiece according to the first embodiment includes: an oscillation section 101 for outputting a timing reference signal of approximately 32 kHz; a dividing section 102 for inputting the timing reference signal from the oscillation section 101 and dividing the inputted signal; an indication control section 103 for inputting a divided signal from the dividing section 102 to thereby control a motor; a data storage section 104 having a writable nonvolatile memory for storing second rate fast/slow data (rate fast/slow data for making a finished accuracy fine adjustment in a complete state) and other data; a rate fast/slow section 105 for performing a logical rate adjustment operation, or a logic fast/slow operation, by controlling the dividing section 102; a crown state detection section 106 for detecting the state of a crown and outputting a crown state detection signal; and a data input control section 107 for inputting the divided signal from the dividing section 102 when the crown state detection signal is inputted from the crown state detection section 106 and outputting the second rate fast/slow data to the data storage section 104.

Here, the rate fast/slow section 105 has a board pattern disconnecting circuit (circuit that stores data by disconnecting a desired one of some data lines which are pulled down inside an IC and which are connected to a power line outside the IC), holds first rate fast/slow data (rate fast/slow data for making a rough accuracy adjustment) using the board pattern disconnecting circuit, inputs second rate fast/slow data from the data storage section 104, and calculates a logic fast/slow amount from the first and second rate fast/slow data.

Note that the high-accuracy timepiece according to the first embodiment is designed so that appropriate second rate fast/slow data is inputted to the data storage section 104 through operation of the crown by the operator after a rate inspection has been made in a complete state at a factory. The appropriate second rate fast/slow data is calculated from the rate inspection result.

Figure 2:
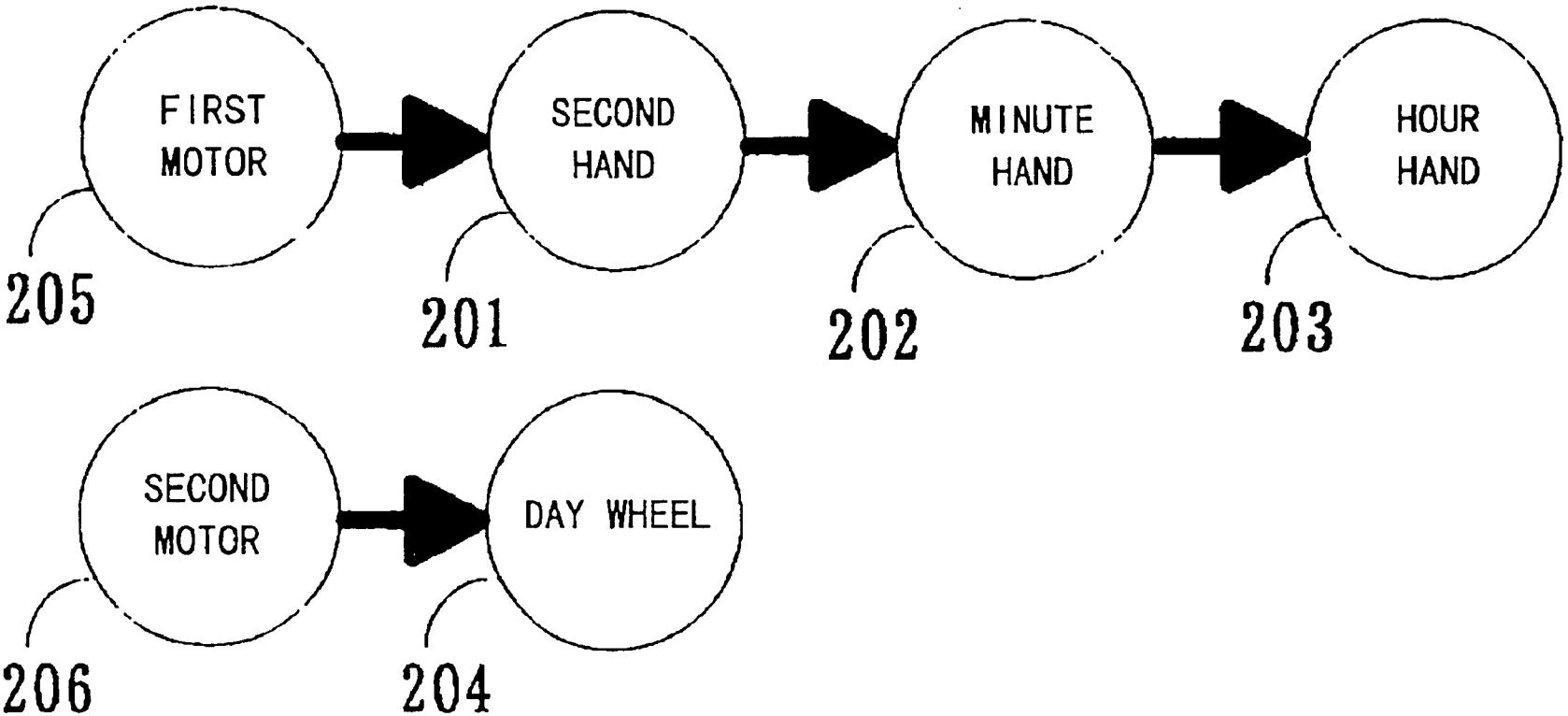
FIG. 2 is a system diagram showing a method of driving a second hand, a minute hand, an hour hand and a day wheel.

Next, how a second hand, a minute hand, an hour hand and a day wheel are driven by motors will be described with reference to FIG. 2. FIG. 2 is a system diagram showing a method of driving a second hand 201, a minute hand 202, an hour hand 203 and a day wheel 204. The high-accuracy timepiece according to the first embodiment has the second hand 201, the minute hand 202, the hour hand 203 and the day wheel 204, and a first motor 205 for driving the second hand 201, the minute hand 202 and the hour hand 203, and a second motor 206 for driving the day wheel 204. Here, the second motor 206 drives the day wheel 204 to thereby give indication associated with inputting of the second rate fast/slow data.

Figure 3:
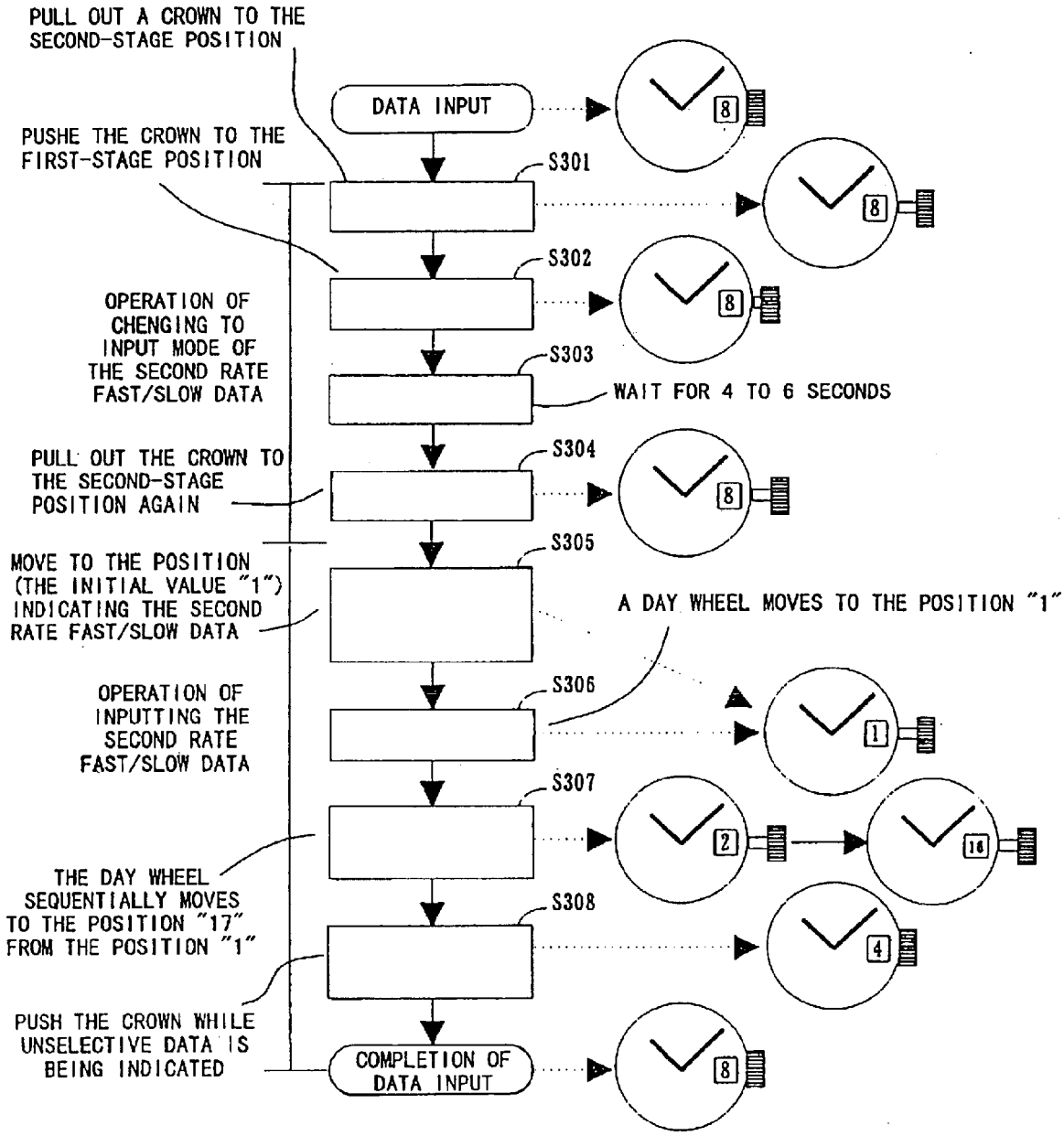
FIG. 3 is an explanatory diagram showing an operation method for selecting a second rate fast/slow data input mode and an operation method for inputting second rate fast/slow data.

Next, how the second rate fast/slow data is inputted will be described in brief with reference to FIG. 3 and in detail with reference to FIG. 4. FIG. 3 is an explanatory diagram showing the operation of selecting a second rate fast/slow data input mode and a method of inputting the second rate fast/slow data. First of all, the operator pulls out the crown to the second-stage position (step S301),pushes the crown to the first-stage position (step S302), waits for 4 to 6 seconds (step S303), and pulls out the crown to the second-stage position again (step S304). As a result of this operation, the second rate fast/slow data input mode is selected in the high-accuracy timepiece according to the first embodiment.

Successively, the day wheel 204 moves to the position indicating the second rate fast/slow data at this time (if the second rate fast/slow data has never been inputted up to this time, the initial value 1 is set as the second-rate fast/slow data) (step S305). Then, the day wheel 204 moves to the position 1 (step S306), and sequentially moves to the position 17 from the position 2 (step S307). Here, the values 1 to 17 indicated by the day wheel are the values of the second rate fast/slow data. When the operator pushes the crown to the 0-stage position as the final step S307 while the appropriate second rate fast/slow data is being indicated (step S308), the operation of inputting the second rate fast/slow data is complete.

Here, to prevent the operator from erroneously changing the appropriate second rate fast/slow data due to unintended switching over to the second rate fast/slow data input mode, the operaiton of selecting the second rate fast/slow data input mode is devised, e.g., so as to include the skilled operation of pushing the crown from the second to the first stage (step S302).

Figure 4:
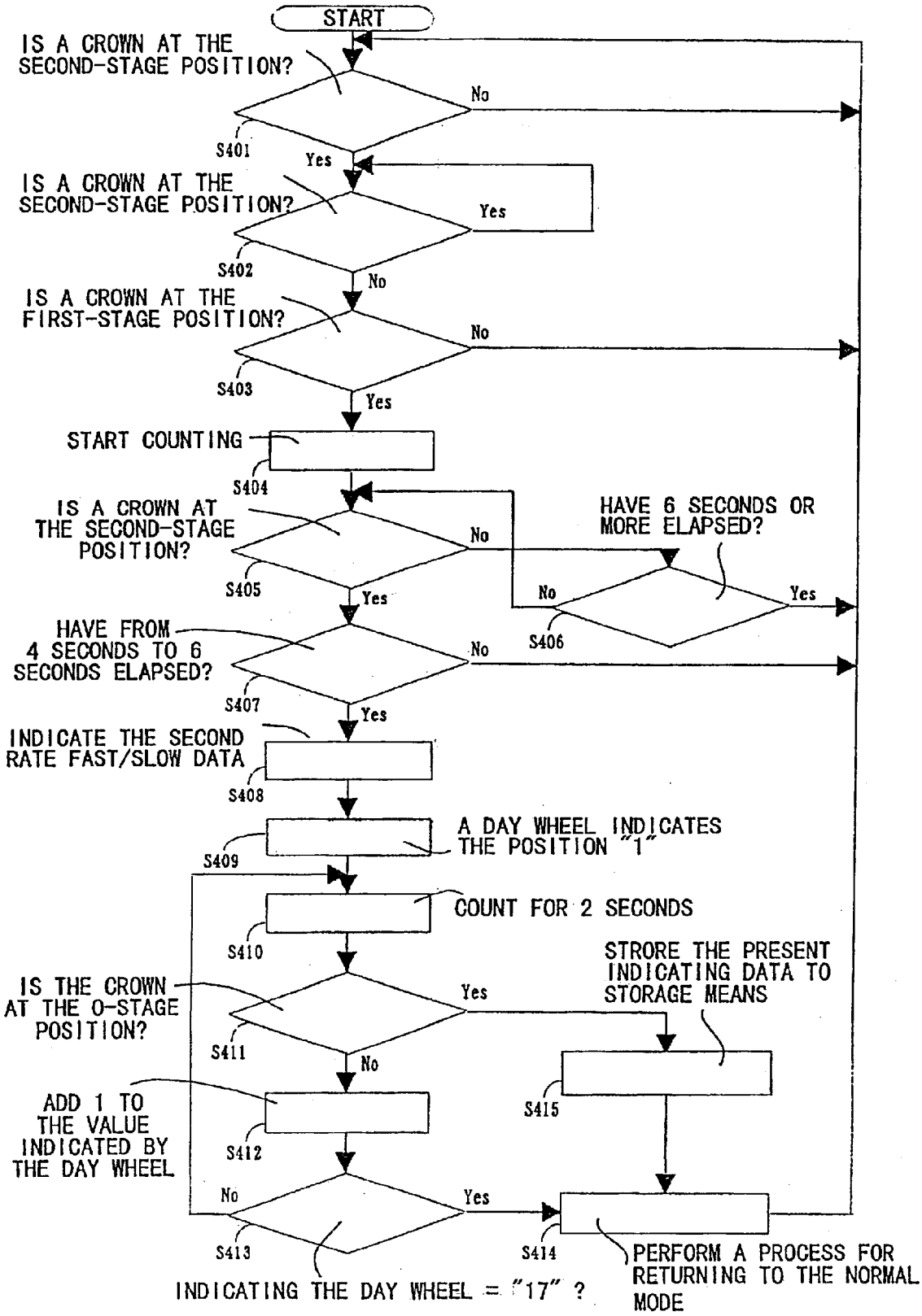
FIG. 4 is a flowchart showing a second rate fast/slow data input process performed by a data input control section.

FIG. 4 is a flowchart showing a second rate fast/slow data input process performed by the data input control section 107 according to the first embodiment. First, in step S401, the data input control section 107 waits until it receives from the crown state detection section 106 a crown state detection signal indicating that the crown is at the second-stage position. When receiving the crown state detection signal indicating that the crown is at the second-stage position, the section 107 goes to step S402. In step S402, the section 107 waits until the crown position changes, and when the crown position has changed, the section 107 goes to step 403.

In step S403, the section 107 determines whether or not the crown is at the first-stage position. If the crown is not at the first-stage position, the section 107 returns to step S401, whereas if the crown is at the first-stage position, the section 107 starts counting the divided signal from the dividing section (step S404), and then goes to step S405.

In step S405, the section 107 determines whether or not the crown is at the second-stage position. If the crown is not set at the second-stage position, the section 107 goes to step S406. In step S406, the section 107 determines whether or not 6 seconds or more have elapsed from the divided signal count start. If 6 seconds or more have elapsed from the divided signal count start, the section 107 stops counting the divided signal, and returns to step S401. If 6 seconds or more have not elapsed, the section 107 returns to step S405. If the crown is at the second-stage position in step S405, the section 107 goes to step S407.

In step S407, the section 107 determines whether or not a time interval between the divided signal count start and the present is equal to or greater than 4 seconds and smaller than 6 seconds. If the time elapsed from the divided signal count start is less than 4 seconds or is 6 seconds or more, the section 107 stops counting the divided signal and returns to step S401. If the time elapsed from the divided signal count start is equal to or greater than 4 seconds and smaller than 6 seconds, the section 107 stops counting the divided signal, and inputs the second rate fast/slow data stored in the data storage section 104 (if the second rate fast/slow data has never been inputted up to this time, the initial value 1 is stored as the second rate fast/slow data). Then, the section 107 moves the day wheel 204 to the position indicating the value of the second rate fast/slow data through the indication control section 103 by controlling the second motor 206 (step S408), and moves the day wheel 204 to the position 1 (step S409). Then, the section 107 counts the divided signal for 2 seconds (step S410), and goes to step S411.

In step S411, the section 107 determines whether or not the crown is at the 0-stage position. If the crown is not at the 0-stage position, the section 107 moves the day wheel 204 to the position indicating the value obtained by adding 1 to the value indicated by the day wheel 204 (step S412), and goes to step S413. In step S413, the section 107 determines whether or not the day wheel 204 indicates 17. If the day wheel 204 does not indicate 17, the section 107 returns to step S410. If the day wheel 204 indicates 17 in step S413, the section 107 performs a process for returning to the normal mode (step S414) and then returns to step S401. If the crown is at the 0-stage position in step S411, the section 107 goes to step S415. Instep S415, the section 107 outputs the value indicated by the day wheel 204 at this time to the data storage section 104 as the second rate fast/slow data, goes to step S414, and then returns to step S401.

As described above, according to the first embodiment, the second rate fast/slow data can be inputted in the complete state through operation of the crown by the operator. Therefore, it is not necessary to additionally provide a receiving circuit inside the high-accuracy timepiece nor is it necessary to provide new manufacturing equipment for outputting a reference signal, and thus the cost of the high-accuracy timepiece can be kept down. Further, since the stored second rate fast/slow data is indicated, the stored second rate fast/slow data can be checked.

Still further, while the first embodiment allows a total of 16 sets of second rate fast/slow data to be inputted, the first embodiment may also be designed so that it allows a total of 17 to 31 sets of second rate fast/slow data to be inputted.

Second Embodiment

The high-accuracy timepiece according to the first embodiment has two motors, the first motor for driving the second hand, the minute hand and the hour hand, and the second motor for driving the day wheel, and causes the first motor to drive the day wheel to give indication for inputting the second rate fast/slow data when the second rate fast/slow data input process is performed. A similar effect can be provided by using a single motor.

Here, a high-accuracy timepiece according to a second embodiment has only one motor, and allows the second rate fast/slow data to be inputted by externally operating the crown in the complete state.

Since the basic construction of the second embodiment is the same as that of the first embodiment, only a method of driving the second hand, the minute hand, the hour hand and the day wheel, which is different, will herein be described.

Figure 5:
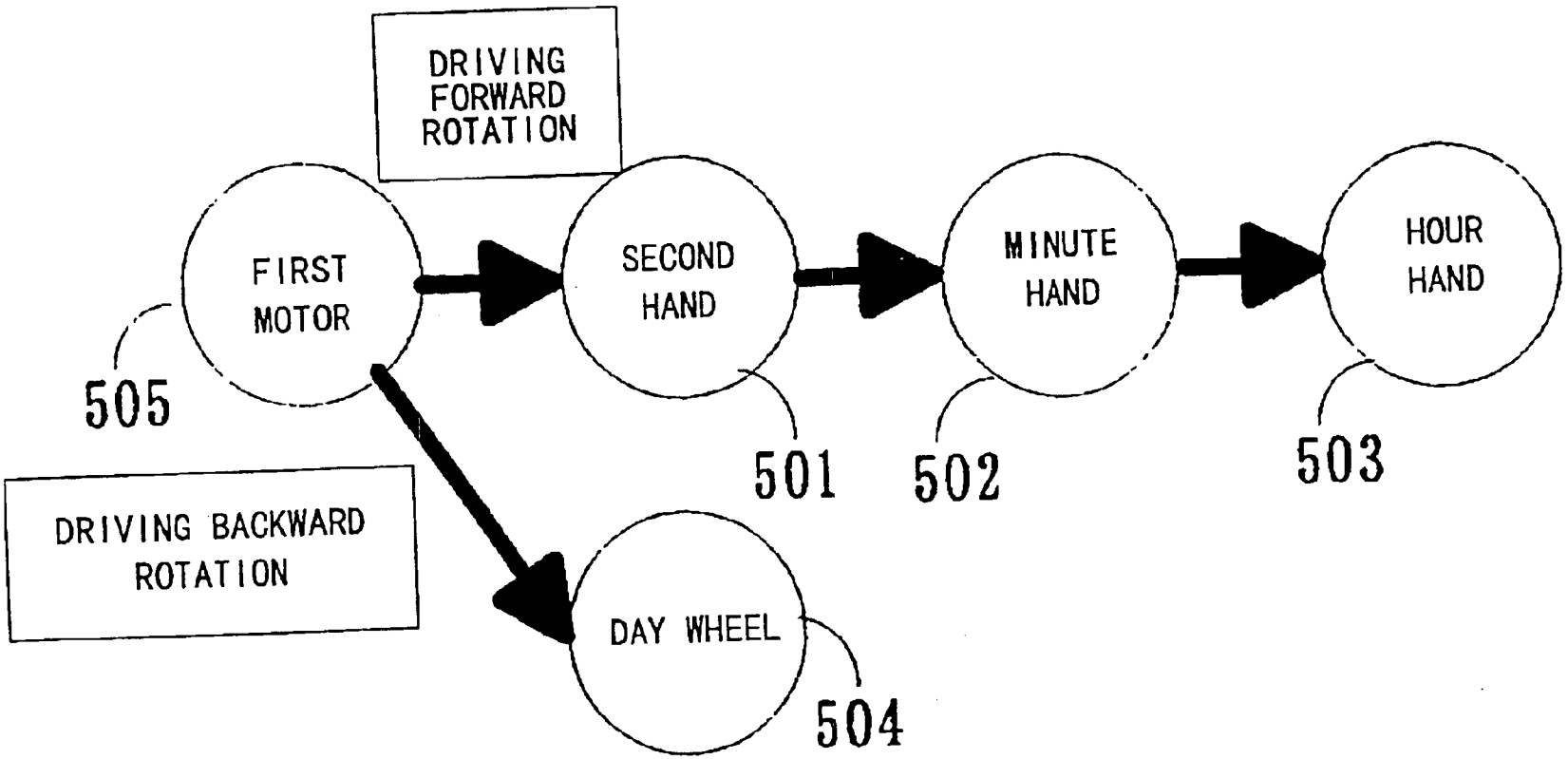
FIG. 5 is a system diagram showing a method of driving a second hand, a minute hand, an hour hand and a day wheel of a high-accuracy timepiece according to a second embodiment of the present invention.

FIG. 5 is a system diagram showing a method of driving a second hand 501, a minute hand 502, an hour hand 503 and a day wheel 504 of a high-accuracy timepiece according to the second embodiment of the present invention. The high-accuracy timepiece according to the second embodiment has the second hand 501, the minute hand 502, the hour hand 503, the day wheel 504, a swing gear and a first motor 505. Here, when the first motor 505 rotates forward, the swing gear meshes with a gear train of a second hand wheel, and the first motor 505 then drives the second hand 501, the minute hand 502 and the hour hand 503 through the swing gear. When the first motor 505 rotates backward, the swing gear oscillates to mesh with a gear train of the day wheel, and the first motor 505 then drives the day wheel 504 through the swing gear. In order to give indication for inputting the second rate fast/slow data, the first motor 505 rotates backward to drive the day wheel 504 through the swing gear.

As described above, according to the second embodiment, the second rate fast/slow data can be inputted in the complete state through operation of the crown by the operator. Therefore, it is not necessary to additionally provide a receiving circuit inside the high-accuracy timepiece nor is it necessary to provide new manufacturing equipment for outputting a reference signal, and thus the cost of the high-accuracy timepiece can be kept down. Further, since the stored second rate fast/slow data is indicated, the stored second rate fast/slow data can be checked.

Third Embodiment

While the day wheel is used to give indication for inputting the second rate fast/slow data in the first and second embodiments, a similar effect can be provided without the day wheel.

Here, a high-accuracy timepiece according to a third embodiment has a second hand, a minute hand and an hour hand, and allows the second rate fast/slow data to be inputted by externally operating the crown in the complete state.

Since the basic construction of the third embodiment is the same as that of the first embodiment, only a method of driving the second hand, the minute hand and the hour hand, which is different, will herein be described.

Figure 6:
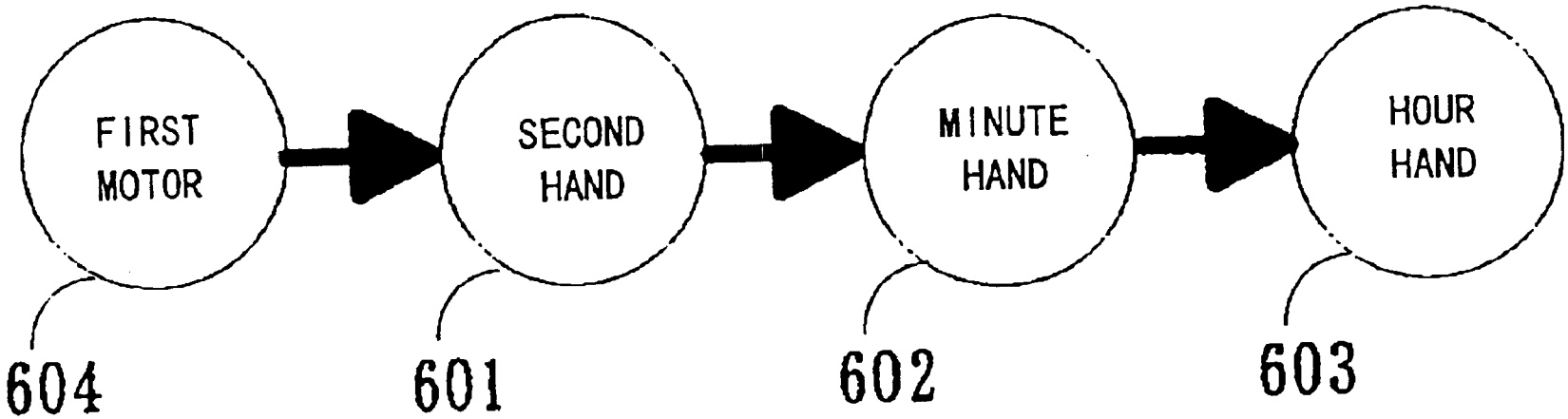
FIG. 6 is a diagram showing a method of driving a second hand, a minute hand, an hour hand of a high-accuracy timepiece according to a third embodiment of the present invention.

FIG. 6 is a diagram showing a method of driving a second hand 601, a minute hand 602 and an hour hand 603 of a high-accuracy timepiece according to the third embodiment of the present invention. The high-accuracy timepiece according to the third embodiment has the second hand 601, the minute hand 602, the hour hand 603 and a first motor 604 for driving the second hand 601, the minute hand 602 and the hour hand 603. Here, the first motor 604 drives the second hand 601 to give indication for inputting the second rate fast/slow data. Therefore, when the rate fast/slow data input process is performed, the second hand 601 indicates the values 1 to 17 instead of the day wheel.

As described above, according to the third embodiment, the second rate fast/slow data can be inputted in the complete state through operation of the crown by the operator. Therefore, it is not necessary to additionally provide a receiving circuit inside the high-accuracy timepiece nor is it necessary to provide new manufacturing equipment for outputting a reference signal, and thus the cost of the high-accuracy timepiece can be kept down. Further, since the stored second rate fast/slow data is indicated, the stored second rate fast/slow data can be checked.

Further, while the third embodiment allows a total of 16 sets of second rate fast/slow data to be inputted, the third embodiment may also be designed so that it allows a total of 17 to 60 sets of second rate fast/slow data to be inputted.

Fourth Embodiment

Since the basic construction of a fourth embodiment is the same as that of the first embodiment, only a method of driving a second hand, a minute hand, an hour hand and a day wheel, which is different, will herein be described.

Figure 7:
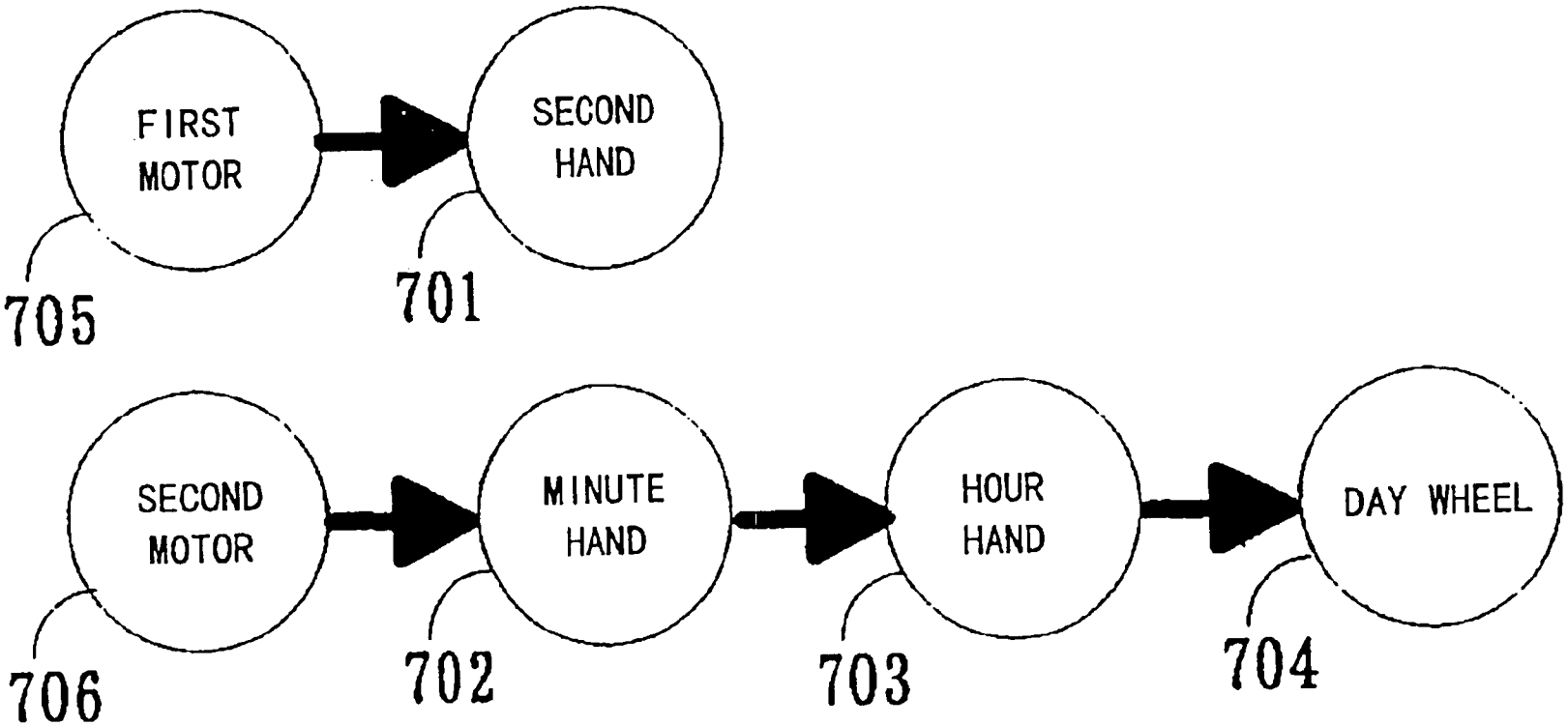
FIG. 7 is a diagram showing a method of driving a second hand, a minute hand, an hour hand and a day wheel of a high-accuracy timepiece according to a fourth embodiment of the present invention.

FIG. 7 is a diagram showing a method of driving a second hand 701, a minute hand 702, an hour hand 703 and a day wheel 704 of a high-accuracy timepiece according to the fourth embodiment of the present invention. The high-accuracy timepiece according to the fourth embodiment has the second hand 701, the minute hand 702, the hour hand 703, the day wheel 704, a first motor 705 for driving the second hand 701, and a second motor 706 for driving the minute hand 702, the hour hand 703 and the day wheel 704. Here, the second motor 706 drives the minute hand 702 to give indication for inputting the second rate fast/slow data. Therefore, when the second rate fast/slow data input process is performed, the minute hand 702 indicates the values 1 to 17 instead of the day wheel.

According to the fourth embodiment, the second rate fast/slow data can be inputted in the complete state through operation of the crown by the operator. Therefore, it is not necessary to additionally provide a receiving circuit inside the high-accuracy timepiece nor is it necessary to provide new manufacturing equipment for outputting a reference signal, and thus the cost of the high-accuracy timepiece can be kept down. Further, since the stored second rate fast/slow data is indicated, the stored second rate fast/slow data can be checked.

Further, while the fourth embodiment allows a total of 16 sets of second rate fast/slow data to be inputted, the fourth embodiment may also be designed so that it allows a total of 17 to 60 sets of second rate fast/slow data to be inputted.

Fifth Embodiment

While the first to fourth embodiments have a writable nonvolatile memory for storing the second rate fast/slow data, a similar effect can be provided without a writable nonvolatile memory.

Here, a high-accuracy timepiece according to a fifth embodiment has a volatile memory and a power backup capacitor in the data storage section, and allows the second rate fast/slow data to be inputted by externally operating the crown in the complete state.

Figure 8:
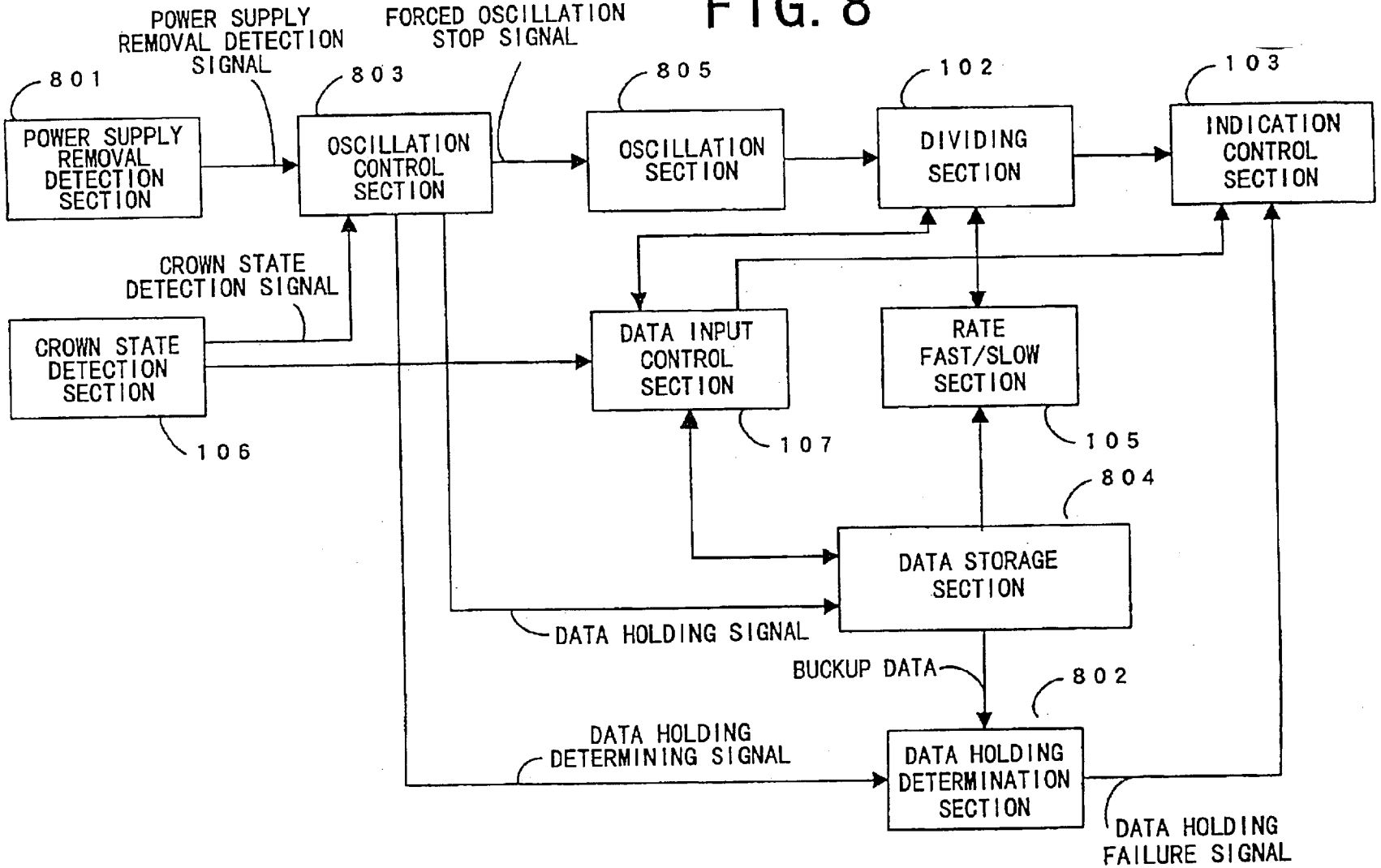
FIG. 8 is a block diagram showing the construction of and the flow of signals in a high-accuracy timepiece according to a fifth embodiment of the present invention.

FIG. 8 is a block diagram showing the construction of and the flow of signals in a high-accuracy timepiece according to the fifth embodiment of the present invention. Since the basic construction of the fifth embodiment is the same as that of the first embodiment, only different portions will herein be described while omitting a description of the same parts and components which are denoted by the same reference numerals.

In addition to the construction of the first embodiment shown in FIG. 1, a high-accuracy timepiece according to the fifth embodiment has a power supply removal detection section 801 for detecting removal of a power supply and outputting a power supply removal detection signal, a data holding determination section 802 for inputting a plurality of copied data of second rate fast/slow data and other data from a data storage section 804 to determine whether or not the data in the data storage section has been held, and an oscillation control section 803 for outputting a forced oscillation stop signal to an oscillation section 805. The forced oscillation stop signal instructs the section 805 to stop oscillating.

Further, the data storage section 804 has, instead of a writable nonvolatile memory, a volatile memory and a power backup capacitor for supplying power to the volatile memory when the power supply is temporarily removed. Note that the data holding determination section 802 outputs a data holding failure signal to the indication control section 103 when determining that the data holding operation has failed. The data holding failure signal instructs the indication control section 103 to indicate the data holding failure.

Figure 9:
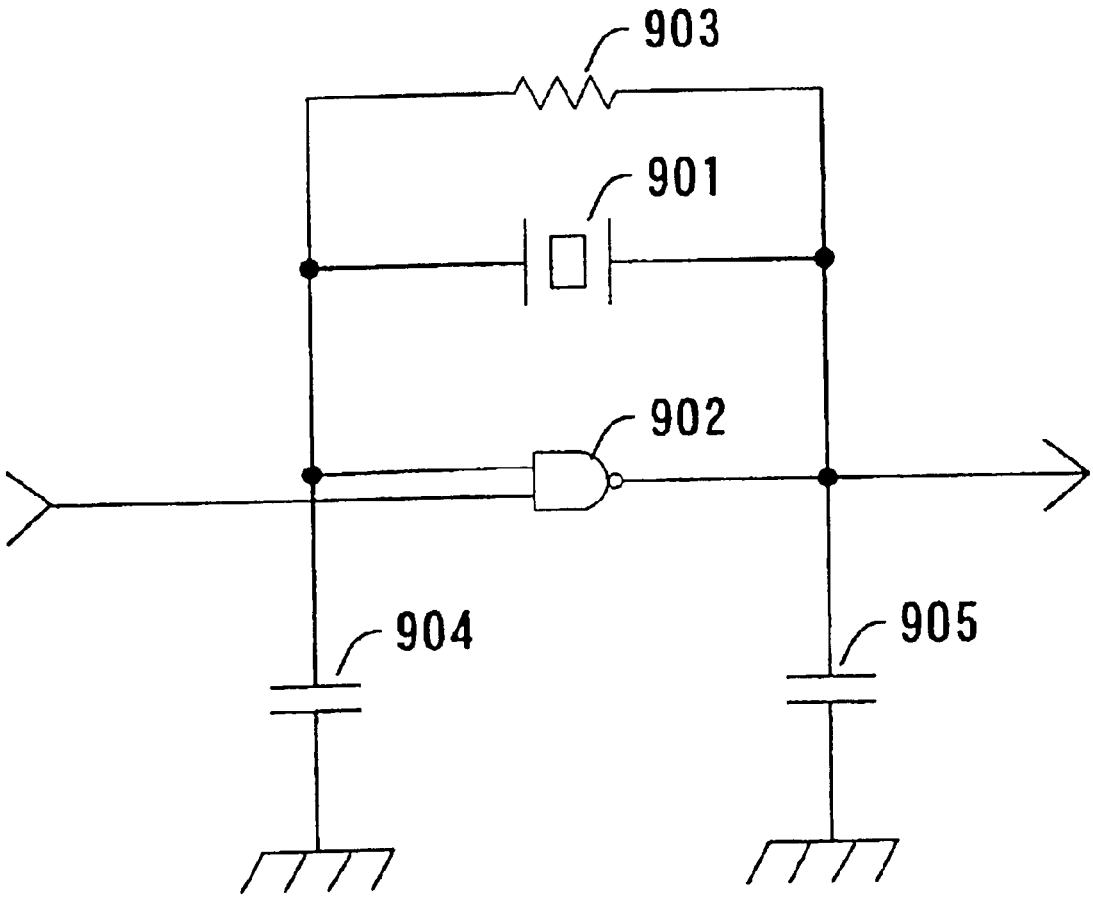
FIG. 9 is a circuit diagram showing an oscillation circuit of an oscillation section shown in FIG. 8.

FIG. 9 is a circuit diagram showing an oscillation circuit of the oscillation section 805 according to the fifth embodiment. The oscillation circuit according to the fifth embodiment comprises a crystal oscillator 901, a NAND circuit 902, a resistor 903 and capacitors 904 and 905. When inputting a negative logic signal, the oscillation circuit stops oscillating, and when inputting a positive logic signal, it starts oscillating.

Figure 10:
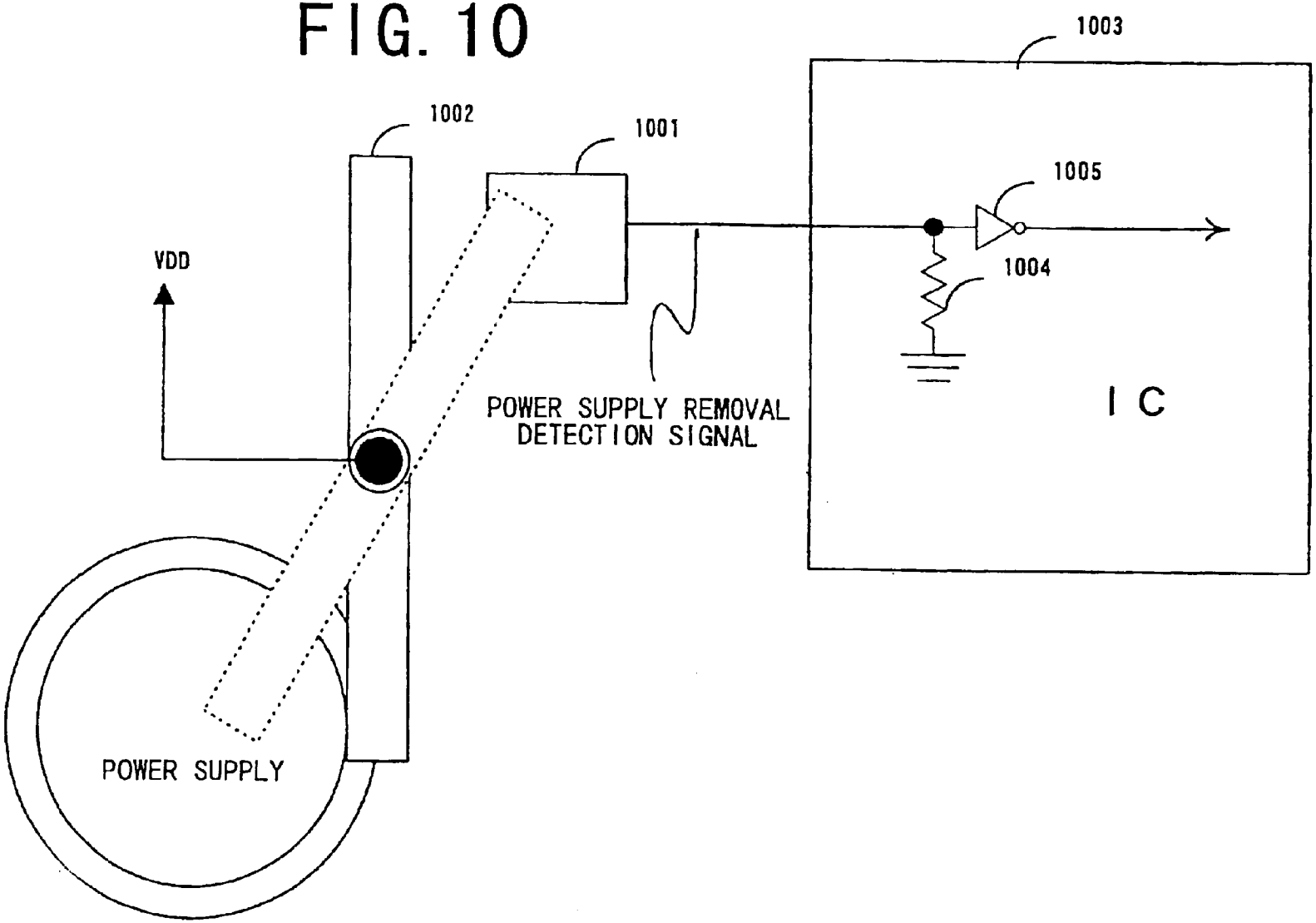
FIG. 10 is a schematic diagram showing the construction of a power supply removal detection section.
Figure 11:
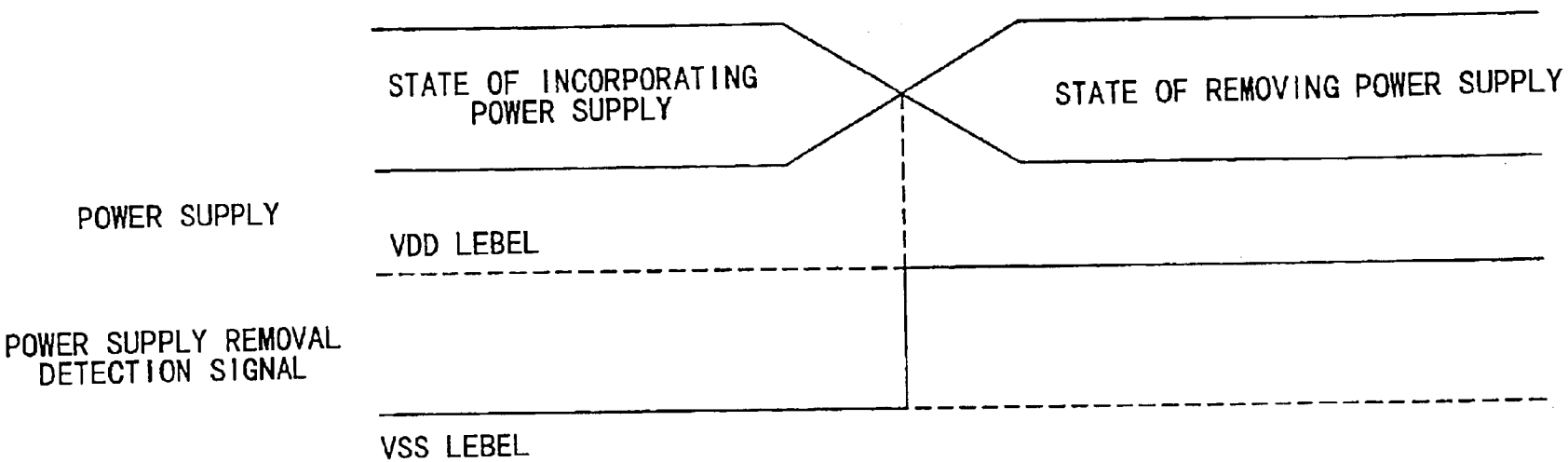
FIG. 11 is a timing chart at the time of a power supply removal detection.

FIG. 10 is a schematic diagram showing the construction of the power supply removal detection section 801, and FIG. 11 is a timing chart at the time of a power supply removal detection. The power supply removal detection section 801 according to the fifth embodiment has a metal terminal 1001, and a metal plate 1002 whose potential is VDD and which moves to come in contact with the metal terminal 1001 when the power supply has been removed. Further, the oscillation control section 803 has an IC 1003. The IC 1003 incorporates therein a resistor 1004 whose potential is VSS at one end thereof, and a NOT circuit 1005. The IC 1003 monitors a power supply removal detection signal (the potential of the metal terminal 1001). When the power is turned on, the metal plate 1002 is distant from the terminal 1001, and thus the potential of the power supply removal detection signal is VSS, whereas when the power has been removed, the metal plate 1002 is in contact with the terminal 1001, and thus the potential of the power supply removal detection signal is VDD.

Figure 12:
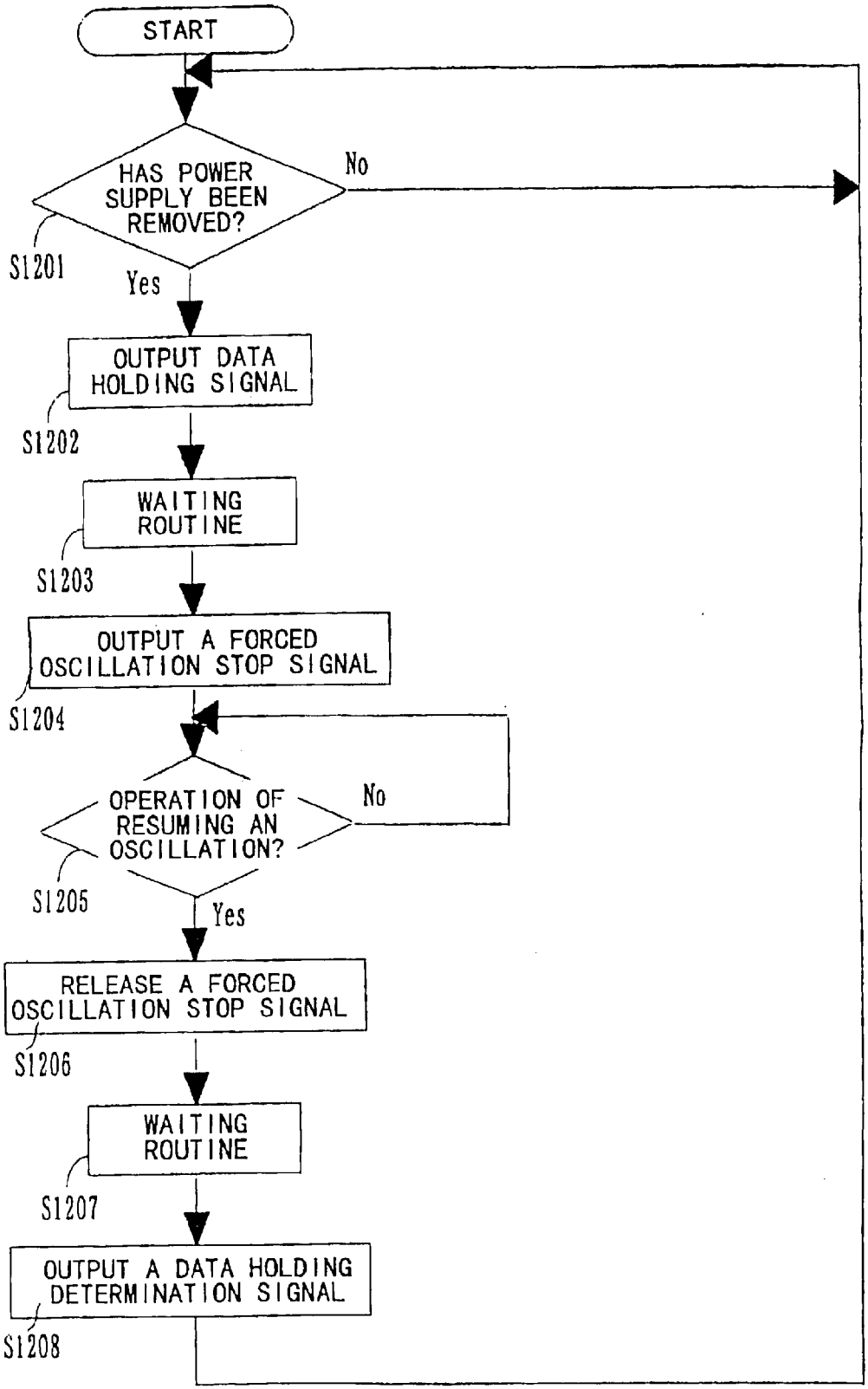
FIG. 12 is a flowchart showing the operation of an oscillation control section.

In the aforementioned construction, a process performed by the oscillation control section 803 at the time of a temporary removal of the power supply and after the temporary removal of the power supply will be described. FIG. 12 is a flowchart showing the operation of the oscillation control section 803.

First of all, the oscillation control section 803 waits until it receives from the power supply removal detection section 801 a power supply removal detection signal indicating that the power supply has been removed (step S1201). When the section 803 receives from the power supply removal detection section 801 the power supply removal detection signal indicating that the power supply has been removed in step S1201, the section 803 outputs to the data storage section 104 a data holding signal for instructing the section 104 to store a plurality of copied data of the second rate fast/slow data and other data (step S1202), waits for a given time (step S1203), and outputs a forced oscillation stop signal to the oscillation section 101 to cause the section 101 to stop oscillating (step S1204).

Next, the oscillation control section 803 determines how the crown is operated by inputting a crown state detection signal from the crown state detection section 106, and then waits until the operation of resuming an oscillation for the crown is performed (step S1205). When the operation of resuming an oscillation is performed for the crown in step S1205, the section 803 releases the forced oscillation stop signal to the oscillation section 101 to cause the section 101 to resume the oscillation (step S1206), waits for a given time (step S1207), outputs a data holding determination signal to the data holding determination section 802 and returns to step S1201 (step S1208).

As described above, according to the fifth embodiment, the second rate fast/slow data can be inputted in the complete state through operation of the crown by the operator. Therefore, it is not necessary to additionally provide a receiving circuit inside the high-accuracy timepiece nor is it necessary to provide new manufacturing equipment for outputting a reference signal, and thus the cost of the high-accuracy timepiece can be kept down. Further, an inexpensive volatile memory and a power backup capacitor are used in place of an expensive writable nonvolatile memory. Therefore, the cost of the high-accuracy timepiece can be kept down. Still further, since the stored second rate fast/slow data is indicated, the stored second rate fast/slow data can be checked.

As described in the foregoing, the high-accuracy timepiece according to the present invention can input rate fast/slow data in the complete state through operation of the crown by the operator. Therefore, it is not necessary to additionally provide a receiving circuit inside the high-accuracy timepiece nor is it necessary to provide new manufacturing equipment for outputting a reference signal, and thus the cost of the high-accuracy timepiece can be kept down. Further, since the rate fast/slow data is inputted by operating the crown, there is no need to provide a button.

Further, the high-accuracy timepiece according to the present invention can input rate fast/slow data in the complete state by causing the operator to operate external input means such as a button. Therefore, it is not necessary to additionally provide a receiving circuit inside the high-accuracy timepiece nor is it necessary to provide new manufacturing equipment for outputting a reference signal, and thus the cost of the high-accuracy timepiece can be kept down. Further, since the rate fast/slow data and other data are stored in a writable nonvolatile memory or other data storage means, there is no need to set the data again after the battery has been replaced.

Further, the high-accuracy timepiece according to the present invention can input rate fast/slow data by operating the crown. Therefore, there is no need to provide a button.

Further, the high-accuracy timepiece according to the present invention can input rate fast/slow data in the complete state by causing the operator to operate external input means. Therefore, it is not necessary to additionally provide a receiving circuit inside the high-accuracy timepiece nor is it necessary to provide new manufacturing equipment for outputting a reference signal, and thus the cost of the high-accuracy timepiece can be kept down.

Further, the high-accuracy timepiece according to the present invention determines what operation is performed by external means at which timing. Therefore, the operation of selecting the rate fast/slow data input mode is so complicated as to include also a timing requirement. As a result, the probability of accidental switching over to the rate fast/slow data input mode by the user is reduced.

Further, since the high-accuracy timepiece according to the present invention indicates stored rate fast/slow data, the operator can be informed of the stored rate fast/slow data.

Further, the high-accuracy timepiece according to the present invention holds the first rate fast/slow data for making a rough adjustment independently of the second rate fast/slow data for making a fine adjustment. Therefore, should the second rate fast/slow data be lost, there is no likelihood that the timepiece will go wrong to so large an extent in terms of accuracy.

Further, since the high-accuracy timepiece according to the present invention gives indication for the rate fast/slow data, the rate fast/slow data can be inputted easily.

Further, the high-accuracy timepiece according to the present invention gives indication for inputting the rate fast/slow data using the day wheel. Therefore, there is no need to provide a liquid crystal display screen.

Further, the high-accuracy timepiece according to the present invention gives indication for inputting the rate fast/slowdata using the second hand. Therefore, there is no need to provide a liquid crystal display screen.

Further, the high-accuracy timepiece according to the present invention gives indication for inputting the rate fast/slow data using the minute hand. Therefore, there is no need to provide a liquid crystal display screen.

Further, the high-accuracy timepiece according to the present invention gives indication for inputting the rate fast/slow data using the hour hand. Therefore, there is no need to provide a liquid crystal display screen.

Further, the high-accuracy timepiece according to the present invention has a second motor for driving the day wheel in addition to a first motor for driving the second hand, the minute hand and the hour hand. Therefore, indication for inputting the rate fast/slow data can be given by the day wheel.

Further, the high-accuracy timepiece according to the present invention includes a single motor which drives the second hand, the minute hand and the hour hand when rotating forward and which drives the day wheel when rotating backward through a swing gear. Therefore, indication for inputting the rate fast/slow data can be given by the day wheel.

Further, the high-accuracy timepiece according to the present invention includes a single motor for driving the second hand, the minute hand and the hour hand. Therefore, indication for inputting the rate fast/slow data can be given by the second hand.

Further, the high-accuracy timepiece according to the present invention includes a first motor for driving the second hand and a second motor for driving the minute hand, the hour hand and the day wheel. Therefore, indication for inputting the rate fast/slow data can be given by the minute hand.

Further, the high-accuracy timepiece according to the present invention includes a first motor for driving the second hand and the minute hand and a second motor for driving the hour hand and the day wheel. Therefore, indication for inputting the rate fast/slow data can be given by the hour hand.

Further, the high-accuracy timepiece according to the present invention has an inexpensive volatile memory and a power backup capacitor in place of an expensive writable nonvolatile memory. Therefore, the cost of the high-accuracy timepiece can be kept down.

Further, the high-accuracy timepiece according to the present invention determines whether or not data in the data storage means has been held and indicates the determination result. Therefore, whether or not the data has been held can be checked.

Further, the high-accuracy timepiece according to the present invention determines whether or not data in the data storage means has been held by an appropriate method and indicates the determination result. Therefore, whether or not the data has been held can be checked.

Further, the high-accuracy timepiece according to the present invention resumes an oscillation by an external operation. Therefore, the problem of chattering at the power supply caused in the case where an oscillation is resumed detection of the power supply inserted can be avoided.

Further, the high-accuracy timepiece according to the present invention has an inexpensive volatile memory and a power backup capacitor in place of an expensive writable nonvolatile memory. Therefore, the cost of the high-accuracy timepiece can be kept down.

Further, the high-accuracy timepiece according to the present invention determines whether or not data in the data storage means has been held and indicates the determination result. Therefore, whether or not the data has been held can be checked.

Further, the high-accuracy timepiece according to the present invention determines whether or not data in the data storage means has been held by an appropriate method and indicates the determination result. Therefore, whether or not the data has been held can be checked.

Further, the high-accuracy timepiece according to the present invention resumes an oscillation by an external operation. Therefore, the problem of chattering at the power supply caused in the case where an oscillation is resumed upon detection of the power supply inserted can be avoided.

What is claimed is:

1. A high-accuracy timepiece having accuracy adjustment means for adjusting the timekeeping accuracy of the timepiece by inputting accuracy adjustment data when the timepiece is in a fully assembled state, the accuracy adjustment means comprising: writable data storage means for storing data before a power supply is temporarily removed so that the data remains stored even after the power supply has been temporarily removed; manually operable external input means for inputting the accuracy adjustment data; state detection means for detecting a state of the external input means and outputting a state detection signal depending on the state of the external input means; and data input control means for inputting the state detection signal from the state detection means, determining whether a predetermined operation has been performed by manual operation of the external input means, and, when the predetermined operation has been performed, determining that accuracy adjustment data is to be input, and causing the data storage means to store the accuracy adjustment data specified by means of manual operation of the external input means.

2. A high-accuracy timepiece according to claim 1; wherein the external input means comprises a crown.

3. A high-accuracy timepiece having accuracy adjustment means for adjusting the timekeeping accuracy of the timepiece by inputting and storing in a writable data storage means accuracy adjustment data used for adjusting the timekeeping accuracy of the timepiece when the timepiece is in a fully assembled state, the accuracy adjustment means having accuracy adjustment data input means comprising: a manually operable crown movable between a first stare in which accuracy adjustment data is to be input and a second state in which accuracy adjustment data is not to be input; crown state detection means for detecting the state of the crown and outputting a crown state detection signal depending on whether the crown in is in the first state or the second state; data input control means for inputting the crown state detect ion signal from the crown state detection means, determining whether a predetermined operation has been performed by manual movement of the crown, and, when the predetermined operation has been performed, determining that accuracy adjustment data is to be input, and causing the data storage means to store accuracy adjustment data that is supplied thereto; oscillation means for outputting a timing reference signal; dividing means for inputting the timing reference signal output by the oscillation means and dividing the timing reference signal to produce a divided output signal; indication means for indicating time counted based on the divided output signal of the dividing means; rate adjustment means for inputting the accuracy adjustment data from the data storage means, calculating a rate adjustment amount, and controlling the dividing means so as to perform a rate adjustment operation; power supply removal detection means for detecting removal of a power supply of the timepiece; and oscillation control means for controlling the oscillation means to start or stop oscillation; wherein the data storage means has a memory and a power unit for holding a content of the memory when the power supply of the timepiece is removed.

4. A high-accuracy timepiece according to claim 3; further comprising data holding determination means for determining whether or not data in the data storage means has been held; and wherein the indication means includes means for indicating a result of the determination.

5. A high-accuracy timepiece according to claim 4; wherein the oscillation control means includes means for receiving a power supply removal detection signal from the power supply removal detection moans, determining whether or not the power supply has been removed, and when it has determined that the power supply has beer removed, storing a plurality of copied data of the accuracy adjustment data in the data storage means; and wherein the data holding determination means includes means for inputting the plurality of copied data stored in the data storage means and determining whether or not the data in the data storage means has been held based on any one of a condition wherein the plurality of copied data are the same, a condition wherein values of the plurality of copied data are within a given range, and a condition wherein all the values of the plurality of copied data have a value of 0 or 1.

6. A high-accuracy timepiece according to claim 4; wherein the oscillation control means includes means for inputting the state detection signal from the state detection means determining whether a predetermined operation has been performed by manual operation at the crown, and, when an operation for resuming oscillation has been performed, controlling the oscillation means to resume the oscillation and controlling the data holding determination means to make a data holding determination.

7. A high-accuracy timepiece having oscillation means for outputting a timing reference signal comprising: data storage means having a memory for storing accuracy adjustment data and a backup power supply for supplying power for holding a content of the memory; power supply removal detection means for detecting the removal of a power supply of the timepiece; and oscillation control means for controlling the oscillation means to stop or resume oscillation.

8. A high-accuracy timepiece according to claim 7; further comprising data holding determination means for determining whether or not data has been held in the data storage means; and indication means for indicating a detection result obtained by the data holding determination means.

9. A high-accuracy timepiece according to claim 8; wherein the oscillation control means includes means for inputting the power supply removal detection signal from the power supply removal detection means, determining whether or not the power supply has been removed, and when it has been determined that the power supply has been removed, storing a plurality of copied data of the accuracy adjustment data in the data storage means; and wherein the data holding determination means includes means for inputting the plurality of copied data stored in the data storage means and determining whether or not the data in the data storage means has been held based on any one of a condition wherein the plurality of copied data are the same, a condition wherein values of the plurality of copied data are within a given range, and a condition wherein all the values of the plurality of copied data have a value of 0 or 1.

10. A high-accuracy timepiece according to claim 8; further comprising manually operable external input means for inputting the accuracy adjustment data; state detection means for detecting a state of the external input means and for outputting a state detection signal; wherein the oscillation control means includes means for inputting the state detection signal from the state detection means, determining whether a predetermined operation has been performed by manual operation of the external input means, and, when an operation for resuming oscillation has been performed, controlling the oscillation means to resume oscillation and controlling the data holding determination means to make a data holding determination.

* * * * *